United States Patent [19]

Bornstein et al.

[11] 4,142,023

[45] Feb. 27, 1979

[54] METHOD FOR FORMING A SINGLE-PHASE NICKEL ALUMINIDE COATING ON A NICKEL-BASE SUPERALLOY SUBSTRATE

[75] Inventors: Norman S. Bornstein, West Hartford; Michael A. DeCrescente, Wethersfield, both of Conn.

[73] Assignee: United Technologies Corporation, Hartford, Conn.

[21] Appl. No.: 827,420

[22] Filed: Aug. 24, 1977

Related U.S. Application Data

[63] Continuation of Ser. No. 641,206, Dec. 16, 1975, abandoned.

[51] Int. Cl.[2] ..... C23C 13/02

[52] U.S. Cl. ..... 428/680; 427/405; 427/383 D; 427/252; 427/253

[58] Field of Search ..... 427/252, 253, 405, 419 R, 427/383 C, 383 D, 328; 29/197; 428/652, 680, 678, 938

[56] References Cited

U.S. PATENT DOCUMENTS

| | | | |
|---|---|---|---|
| 2,809,127 | 10/1957 | Gibson | 427/405 |
| 2,970,065 | 1/1961 | Greene et al. | 427/273 |
| 3,061,463 | 10/1962 | Samuel | 427/252 |
| 3,079,276 | 2/1963 | Puyer et al. | 427/253 |
| 3,141,744 | 7/1964 | Couch et al. | 428/680 |
| 3,290,126 | 12/1966 | Monson | 427/252 |
| 3,556,744 | 1/1971 | Berkley et al. | 428/652 |
| 3,595,712 | 7/1971 | Boone et al. | 427/252 |
| 3,647,517 | 3/1972 | Milidantri et al. | 427/252 |
| 3,656,919 | 4/1972 | Lucas et al. | 428/680 |
| 3,716,398 | 2/1973 | Stueber et al. | 427/253 |
| 3,764,373 | 10/1973 | Speirs et al. | 427/253 |
| 3,785,854 | 1/1974 | Baldi | 427/252 |
| 3,801,353 | 4/1974 | Brill-Edwards | 427/252 |
| 3,936,539 | 2/1976 | Baldi | 427/253 |
| 3,998,603 | 12/1976 | Rairden | 428/680 |
| 4,041,196 | 8/1977 | Baldi et al. | 427/252 |

OTHER PUBLICATIONS

Goward et al., "Mechanisms of Formation of Diffusion Aluminide Coatings on Nickel-Base Superalloys", Oxidation of Metals, vol. 3, No. 5, 1971.

*Primary Examiner*—Michael F. Esposito
*Assistant Examiner*—Sadie L. Childs
*Attorney, Agent, or Firm*—Steven F. Stone

[57] ABSTRACT

A method for coating a nickel-base superalloy substrate with a nickel-aluminide coating, saturated with chromium and containing no precipitated phases is disclosed which comprises enriching the superalloy substrate with chromium by diffusion of chromium into the substrate at a rate below that at which a pure or alloyed chromium layer forms and then growing a nickel aluminide coating on the chromium enriched substrate surface by the outward diffusion of nickel from the substrate into an aluminum-containing pack in which the source of aluminum is the stoichiometric intermetallic compound NiAl, or a metal powder mixture having the overall aluminum activity of NiAl.

9 Claims, No Drawings

METHOD FOR FORMING A SINGLE-PHASE NICKEL ALUMINIDE COATING ON A NICKEL-BASE SUPERALLOY SUBSTRATE

This is a continuation of application Ser. No. 641,206, filed Dec. 16, 1975 now abandoned.

BACKGROUND OF THE INVENTION

Nickel aluminide coatings are known to improve the impact and oxidation resistance of superalloy substrates and their use for this purpose is widely practiced. Although the specific details of the coating processes may vary, the overall process may be briefly described as the formation of a nickel aluminide coating by reacting a source of aluminum with the superalloy substrate. Depending upon the temperatures used, the initial phases formed are delta ($Ni_2Al_3$) and beta (NiAl) or almost pure delta. In either case the coated specimen is again heat treated in the absence of aluminum to convert the delta phase to NiAl. This is usually accomplished by a second heat treatment or during high temperature exposure of the aluminized part. In these processes, there is no change in the dimensions of the aluminized part since the coating is formed by inward diffusion of aluminum into the superalloy substrate to form the coating.

Typically, these processes for forming a nickel-aluminide coating on a superalloy substrate involve the packing of the substrate to be coated in an aluminum-containing pack. In addition to the aluminum, other materials can be present, typical of which would be a transfer agent whose function is to assist in the transfer by diffusion of the aluminum from the pack to the substrate and an inert diluent. The pack containing the substrate would be heated up to approximately 2000° F. and maintained at this temperature for a sufficient period of time to enable the aluminum to react with the substrate surface.

It should be recognized that while the overall process is that as described above, specific details can vary such as the environment, i.e., air, vacuum or inert atmosphere; the source of aluminum, i.e., pure aluminum powder or a prealloyed aluminum powder; the type accelerator, if any, i.e., ammonium chloride, ammonium fluoride or other metal halide as well as the temperatures and times of treatment. Numerous references in the prior art exist and U.S. Pat. Nos. 3,647,517 to Milidantri et al, Mar. 7, 1972, for Impact Resistant Coatings for Cobalt-Base Superalloys and the Like; No. 3,764,373 to Speirs et al, Oct. 9, 1973, for Diffusion Coating of Metals are considered representative.

In the practice of this process it has been found that common alloying elements, such as molybdenum and vanadium, for example, which are often found in nickel-base superalloys, exert an adverse effect upon both the oxidation and sulfidation resistance of the aluminide coatings. In order to, in part, counteract this adverse effect, it has been proposed to introduce chromium into the aluminide coating to produce some improvement in oxidation and corrosion resistance. Such approaches are described in U.S. Pat. No. 3,290,126 to Monson, Dec. 6, 1966, for Protectively Coated Nickel or Cobalt Articles and Process of Making and U.S. Pat. No. 3,801,353 to Brill-Edwards, Apr. 2, 1974, for Method for Coating Heat Resistant Alloys. In these processes the nickel-base superalloy substrate is coated with chromium and then the aluminide coating layer is formed over the chromium layer by techniques corresponding to those described above. Since chromium exists in a body-centered cubic crystal structure, and nickel exists in a face-centered cubic crystal structure, the coated articles produced by processes corresponding to those of Monson or Brill-Edwards result in chromium layer between the substrate and the aluminide coating and in the chromium in the aluminide coating existing as a discrete phase. This renders the structure more susceptible to corrosion and thermal attack as a result of the difference in thermal expansion between the body-centered and face-centered cubic structures as well as from the existence of grain boundaries between the Cr and Ni.

SUMMARY OF THE INVENTION

According to this invention, we have developed a method for producing a chromized aluminide coating on a nickel-based superalloy substrate in which the chromium is totally dissolved in the nickel aluminide coating and, therefore, does not exist as a separate phase or layer. We have observed that articles treated according to the process of our invention exhibit resistance to corrosion substantially greater than that observed for articles having the simple aluminide coatings of the prior art or the more advanced chromized aluminide coatings shown by Monson or Brill-Edwards.

It is, accordingly, an object of this invention to form a single-phase nickel aluminide coating on a superalloy substrate, which coating contains chromium dissolved therein rather than as a precipitated phase. It should be noted that in the process of this invention, as well as in the processes of the prior art, migration of the metals into or out of the substrate causes superficial changes to occur in the substrate beneath the coating which can result in precipitation of separate phases in what was originally the substrate. It should be noted that while this can occur in the process of this invention, it is the coating itself which is desired to be free of any precipitated phases regardless of whether any such precipitation occurs in the original substrate.

DESCRIPTION OF THE PREFERRED EMBODIMENT

Briefly described, this invention contemplates forming a chromized nickel aluminide coating on a nickel-base superalloy substrate by a first step of enriching the surface of the superalloy substrate with chromium and a second step of growing an aluminide coating by the outward diffusion of nickel from the substrate into the surrounding pack rather than by the inward diffusion of aluminum from the pack, as has heretofore been accomplished. Certain critical limitations must be observed in the implementation of the process of this invention in each of these two steps.

In the first step, it is essential that the nickel-base superalloy surface be enriched with chromium without the formation of a coating of either chromium or a chromium alloy with nickel. The art of chromizing superalloy substrates is well developed and, in general the pack diffusion techniques utilized by the prior art can be applied in the practice of this invention, provided that certain restraints are observed. Since it is desired to merely enrich the surface of the superalloy substrate with chromium rather than to form a chromium or a chromium alloy coating on the surface, it is necessary to limit the rate at which the chromium is diffused into the substrate. Since the conventional chromizing techniques are based upon a diffusion of chromium into the substrate from a pack containing a source of chromium, an inert diluent and a carrier, the rate at which the chromium diffuses into the surface can be controlled by appropriate selection of the composition of the chromium-containing material. Since it is the intention of this invention to prevent the formation in the substrate of the body-centered cubic crystal structure, which is characteristic of chromium-based alloys (i.e., nickel in chromium) and retain the face-centered cubic structure of nickel (i.e., chromium in nickel) the desired results can be obtained if the source of chromium in the pack is formed from a prealloyed nickel-chromium powder containing not more than the maximum solid solubility of chromium in nickel. Thus, the upper limit on the chromium concentration in the chromium source in the pack is 40 weight percent and it is preferred that the process be operated with a composition as near to this as possible in order to reduce the time involved in the chromizing step. Any of the inert diluents, such as $Al_2O_3$, $Cr_2O_3$, $ZrO_2$, $HfO_2$ and $TiO_2$ can be used as well as any of the known carriers such as $NH_4Cl$, $NH_4F$, NaCl, LiCl and $AlCl_3$. The time and temperature for the chromizing step can also be varied over wide limits and temperatures of 1400° to 2200° F., at times ranging from 5 to 49 hours have been found to produce the desired results. In a preferred embodiment of this invention alumina is the preferred inert diluent and ammonium chloride is the preferred carrier at 2000° F. for 16 hours.

In the second step it is essential to form the aluminide coating by the outward diffusion of nickel from the substrate into the surrounding pack. Since aluminizing is based on a pack diffusion concept similar to that described with the chromizing process, it again becomes necessary to carefully control the concentration of the aluminum in the pack in order to get diffusion of nickel outwardly from the substrate into the pack, rather than the diffusion of aluminum inwardly from the pack into the substrate. In theory this means that the activity of the aluminum in the pack must be less than that associated with the delta phase aluminide, $Ni_2Al_3$. In translating the theory to practice, this means that if the source of aluminum, whether it be pure aluminum or a prealloy aluminum powder such as 60% chromium, 40% aluminum, is reacted with nickel and the delta-phase forms, the powder is not acceptable. Thus, in the preferred embodiments of the invention, the source of aluminum for the formation of the coating described herein is either the stoichiometric intermetallic compound, NiAl, or a powder of nickel and aluminum having the overall activity of aluminum associated with NiAl either as a uniform mixture of Ni and Al powders or a core of pure aluminum powder surrounded by a jacket of pure nickel powder. "Activity" as used above is as defined in Moore, Physical Chemistry, Second Edition, Prentice Hall, 1955 p. 69 and is readily determined by techniques well known to the art.

Any of the known inert diluents and accelerators for the pack diffusion aluminizing process, which are similar to those described above with respect to the chromizing process, can be employed and temperatures and times of treatment ranging from 1 to 48 hours and temperatures of 1400° to 2200° F. have produced satisfactory results. A preferred embodiment of the invention is operated at 24 hours at 2000° F.

In addition to the production of a coating in which the chromium remains soluble, the process of this invention can also be distinguished from the processes of the prior art in that a slight increase in size of the coated article is obtained since the coating is formed by the outward diffusion of nickel from the substrate into the pack. The inward diffusion of aluminum into the substrate, however, produces almost no increase in size of the coated article.

In certain circumstances it may be desirable to increase the aluminum content of the coating once it has been formed. To accomplish this, the part could then be packed into a canister with a source of pure aluminum and heat treated from 1 to 2 hours at 1400° F., followed by a post treatment for 16 hours at 2000° F. During this treatment, aluminum will diffuse directly into the coating to increase the aluminum content thereof in a manner corresponding to the prior art technique.

EXAMPLE 1

A three-inch long, one-half inch diameter erosion bar of NX1888 (74% nickel, 18% Mo, 8% Al) was coated with an ordinary aluminide coating, three mil in thickness by the teachings of the prior art by a conventional pack diffusion process. The process consisted of embedding the part in a pack comprised of 50% aluminum powder, 48% alumina and 2% $NH_4Cl$ and heat treating for 2 hours at 1400° F.

EXAMPLE 2

Two erosion bars, similar to those used in Example 1, were treated according to the process of Monson et al to provide a NiAl coating containing chromium. In particular, the bars were chromized by being embedded in packs consisting of 25% chromium powder, 0.5% $NH_4Cl$, and the balance alumina and treated at 2000° F. for 16 hours. The chromium-coated parts were then removed from this pack and aluminized by embedment in a pack consisting of 10% aluminum, 0.5% $NH_4Cl$ and the balance alumina. One bar was treated at 1500° F. for 2 hours to produce a 3 mil aluminide coating and the other for 4 hours to produce a 6 mil aluminide coating.

EXAMPLE 3

Two erosion bars corresponding to those used in Examples 1 and 2 were treated according to the process of this invention by being packed into canisters containing 50-weight percent of a prealloyed NiCr powder having a nickel-chromium weight ratio of 60/40, 48 percent alumina and 2% ammonium chloride and were heat-treated for 16 hours at 2000° F. in an inert environment to produce a chromium-enriched surface layer. The erosion bars were then removed from this pack mixture and packed into another canister containing 50-weight percent of powdered NiAl, 48% alumina and 2% ammonium chloride and heat treated at 2000° F. for 16 hours to produce a 4-mil coating and 50 hours to produce a 6-mil coating. Microscopic examination of the coatings so produced showed that the aluminized coating existed as a single-phase of NiAl with no observable chromium precipitates.

EXAMPLE 4

The coated erosion bars produced according to Examples 1, 2, and 3 were then subject to a standard salt erosion life test which comprises exposing the samples to the hot exhaust gases of a laboratory jet burner which are doped to contain 100 ppm synthetic sea salt, and the life of the part in this environment at the part temperature shown is measured. The results are summarized in Table I.

TABLE I

| | Life at 1650° F |
|---|---|
| Ordinary aluminide/3 mil (Example 1) | 0.5 hrs. |
| Ordinary aluminide+chromium/3 mils (Example 2) | 2 hrs. |
| Ordinary aluminide+chromium/6 mils (Example 2) | 15 hrs. |
| Single-phase aluminide+chromium/4 mils (Example 3) | 40 hrs. |
| Single-phase aluminide+chromium/6 mils (Example 3) | 60 hrs. |

While this invention has been described with respect to certain specific embodiments thereof, it should not be construed as being limited thereto. The examples are considered merely illustrative of the best mode contemplated for this invention and various modifications and substitutions may be made by workers skilled-in-the-art without departing from the scope of this invention which is limited only by the following claims, wherein:

We claim:

1. A process for forming on a nickel-base superalloy substrate, a single-phase nickel aluminide coating containing chromium which comprises:

(a) enriching the surface of said nickel-base superalloy substrate with a face centered cubic solution of chromium in nickel, said substrate remaining substantially free from a body-centered cubic coating of chromium or a chromium-base alloy; by diffusing chromium into said substrate from a source of chromium comprising a mixture of nickel and chromium in which the amount of chromium does not exceed the amount of chromium which would be soluble in the nickel; and (b) forming a nickel-aluminide coating on the chromium enriched substrate by causing nickel to diffuse outwardly from said substrate into an aluminum-containing pack in which the source of aluminum is a material selected from the group consisting of the intermetallic compound NiAl and a metal powder pack having the overall activity of aluminum associated with NiAl.

2. The process of claim 1 in which the amount of chromium in the nickel-chromium source of chromium is less than about 40% by weight of the nickel-chromium source.

3. The process of claim 1 wherein the source of aluminum is NiAl.

4. The process of claim 1 wherein the source of aluminum is a uniform mixture of nickel and aluminum powders.

5. The process of claim 1 wherein the source of aluminum is in the form of a core of aluminum powder surrounded by a jacket of nickel powder.

6. The process of claim 3 in which the amount of chromium in the nickel-chromium source of chromium is less than about 40% by weight of the nickel-chromium source.

7. The process of claim 4 in which the amount of chromium in the nickel-chromium source of chromium is less than about 40% by weight of the nickel-chromium source.

8. The process of claim 5 in which the amount of chromium in the nickel-chromium source of chromium is less than about 40% by weight of the nickel-chromium source.

9. The nickel based superalloy having a single phase chromium containing nickel aluminide coating product produced according to the process of claim 1.

* * * * *